US006202618B1

(12) United States Patent
Baxter et al.

(10) Patent No.: US 6,202,618 B1
(45) Date of Patent: Mar. 20, 2001

(54) PISTON WITH TAILORED MECHANICAL PROPERTIES

(75) Inventors: William J. Baxter, Bloomfield Hills; Anil K. Sachdev, Rochester Hills; Raja K. Mishra, Shelby Township, all of MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/401,908

(22) Filed: Sep. 23, 1999

(51) Int. Cl.[7] ..... F02F 3/06
(52) U.S. Cl. ..... 123/193.6
(58) Field of Search ..... 123/193.6; 164/97, 164/98, 120; 92/213, 222

(56) References Cited

U.S. PATENT DOCUMENTS 4,708,104 * 11/1987 Day et al. ..... 123/193.6
4,735,128 * 4/1988 Mahrus et al. ..... 123/193.6
4,848,291 * 7/1989 Kawamura et al. ..... 123/193.6
4,939,984 * 7/1990 Fletcher-Jones ..... 123/193.6
5,074,352 * 12/1991 Suzuki ..... 164/97

* cited by examiner

*Primary Examiner*—Marquerite McMahon

(57) ABSTRACT

The present invention provides a cast piston for an internal combustion engine comprising a crown region subjected to relatively higher service temperature than other regions of the piston. The crown region has a microstructure including an alloy matrix with reinforcing material and strengthening precipitates providing strength properties suited to the higher crown service temperature by virtue of the precipitates having better resistance to averaging as compared to different strengthening precipitates formed in a microstructure of other regions of the piston subjected to lower service temperatures. The different precipitates at the other regions of the piston provide strength properties suited to relatively lower temperatures at those regions.

18 Claims, 3 Drawing Sheets

PISTON WITH TAILORED MECHANICAL PROPERTIES

FIELD OF THE INVENTION

The present invention relates to pistons for internal combustion engines.

BACKGROUND OF THE INVENTION

Cast aluminum alloy pistons are in widespread use in internal combustion engines. Such aluminum alloy pistons typically are strengthened after casting by a precipitation hardening heat treatment. To this end, the aluminum alloy includes alloying elements, such as Si, Mg, Cu, etc., that form intermetallic and other strengthening precipitates in the alloy microstructure as a result of the post-cast precipitation hardening heat treatment.

In service in an internal combustion engine, different regions of the piston operate at substantially different temperatures. For example, in a particular gasoline engine, the crown of the piston typically attains a temperature of approximately 300 degrees C., which is much hotter than the temperature of the piston boss and skirt (e.g. less than 200 degrees C.). The higher temperature at the crown of the piston subjects the microstructure thereof to what is called overaging whereby the strengthening precipitates present in the microstructure grow in size to an extent that the strength of the crown decreases more rapidly than that of the lower temperature piston boss and skirt. This is undesirable in that, in service, the crown of the piston should have high strength to withstand the combustion stresses at higher service temperatures involved.

It is well known in the art to improve one or more properties (e.g. strength, toughness, wear resistance, fatigue resistance, etc.) of metals and alloys by inclusion of reinforcing particles therein, either as dispersed particles or as one or more preformed inserts formed from particulates. The reinforcing particles can comprise elongated fibers, rounded particles, and other particle shapes. Such reinforced metals or alloys are referred to as metal matrix composites (MMC's) wherein the metal or alloy provides the matrix for the reinforcing particles. Metal matrix composites having various reinforcing particles and matrix metals/alloys are described in U.S. Pat. Nos. ,5679,041 and 5,588,477.

Aluminum based MMC's have been considered as candidate materials for use in selective reinforcement of pistons for internal combustion engines. For example, U.S. Pat. Nos. 4,920,864 and 5,505,171 describe pistons having a piston crown or head having an MMC structure for reinforcement purposes.

An object of the present invention is to provide a cast piston for an internal combustion engine, and method of making same, wherein by selective control of the piston microstructure the mechanical properties of the piston are selectively tailored to different service conditions experienced by different regions of the piston.

SUMMARY OF THE INVENTION

The present invention provides a cast piston for an internal combustion engine, and method of making same, wherein a crown region includes a microstructure, including a metallic matrix with reinforcing material and strengthening precipitates therein, providing strength properties, such as fatigue strength, suited to higher crown service temperatures by virtue of the precipitates having better resistance to averaging during engine service as compared to different strengthening precipitates formed in a microstructure of other regions of the piston. The different precipitates at the other regions of the piston provide strength properties, such as fatigue strength, suited to relatively lower temperatures experienced at those regions. The present invention thereby provides a piston having strength properties, such as fatigue strength, selectively tailored to different service temperatures encountered by different regions of the piston. In an illustrative embodiment of the present invention offered for purposes of illustration only and not limitation, a piston is cast by introducing molten matrix-forming alloy into a casting mold and selectively reacting a ceramic reinforcing material and the molten alloy at a crown-forming region of the casting mold to locally alter the alloy composition in the mold crown-forming region. The alloy composition is locally altered in a manner that a subsequent precipitation hardening heat treatment of the cast piston selectively forms strengthening precipitates (e.g. platelet precipitates) in the piston crown microstructure that impart superior fatigue strength to the piston crown region at engine service temperatures by virtue of reduced averaging at such service temperatures. At the same time, different strengthening precipitates (e.g. spheroidal precipitates) are formed in the microstructure of other regions of the piston to provide superior fatigue strength at lower service temperatures experienced by those regions.

The present invention provides a piston having mechanical properties, such as fatigue strength, tailored to accommodate operational temperature distribution of different regions of the piston in service in an internal combustion engine to improve performance of the piston.

The above and other objects and advantages of the present invention will become more readily apparent from the following detailed description taken in conjunction with the following drawings.

DESCRIPTION OF THE INVENTION

Figure 1:
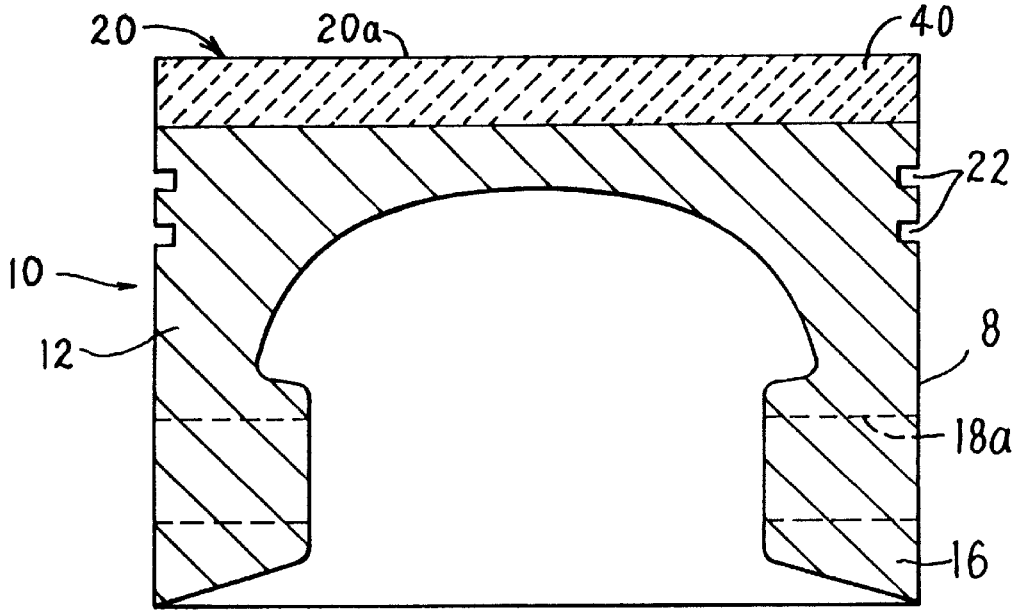
FIG. 1 is a schematic sectional view of a piston of an internal combustion engine that can be made in accordance with an embodiment of the present invention.

Referring to FIG. 1, there is schematically shown a cast piston 10 for use in a gasoline, diesel or other spark ignition internal combustion engine. The piston 10 includes an aluminum alloy body 12 which includes a lower skirt region 16 and boss region 18 and an upper head or crown region 20 having one or more circumferential (two shown) sealing ring-receiving grooves 22 in conventional manner and an upwardly facing wall 20*a* that, together with the cylinder wails and cylinder head (not shown), defines a combustion chamber of the internal combustion engine. The piston boss region 18 includes a boss bore 18*a*, which is machined in the piston after casting. The sealing grooves 22 also are machined in the piston after casting.

As mentioned above, in service in a gasoline internal combustion engine, the crown region 20 of the piston typically attains a service temperature of approximately 300 degrees C. In contrast, the skirt region 16 and the boss region 18 attain a typical service temperature less than 200 degrees C. The present invention involves selectively tailoring the mechanical properties, especially fatigue strength, of the cast piston 10 to the different service temperatures experienced by the crown region 20 versus the skirt region 16 and boss region 18 to improve the performance of the piston in service in the internal combustion engine. For purposes of illustrating and not limiting the present invention, a piston 10 is cast in accordance with an embodiment of the present invention by introducing a molten matrix-forming alloy into a casting mold 30, FIG. 2, having a crown-forming mold cavity region 30*a* configured to form the head or crown region 20 of the piston and other mold cavity regions 30*b*, 30*c* for forming the piston skirt 16 and piston boss 18, the piston boss bore 18*a* and sealing grooves 22 being machined in the cast piston after casting as mentioned. The mold 30 typically comprises a female mold 31 and male mold punch 33 that are relatively movable in conventional manner so as to apply pressure on the molten matrix-forming alloy filling the female mold 31.

Figure 2:
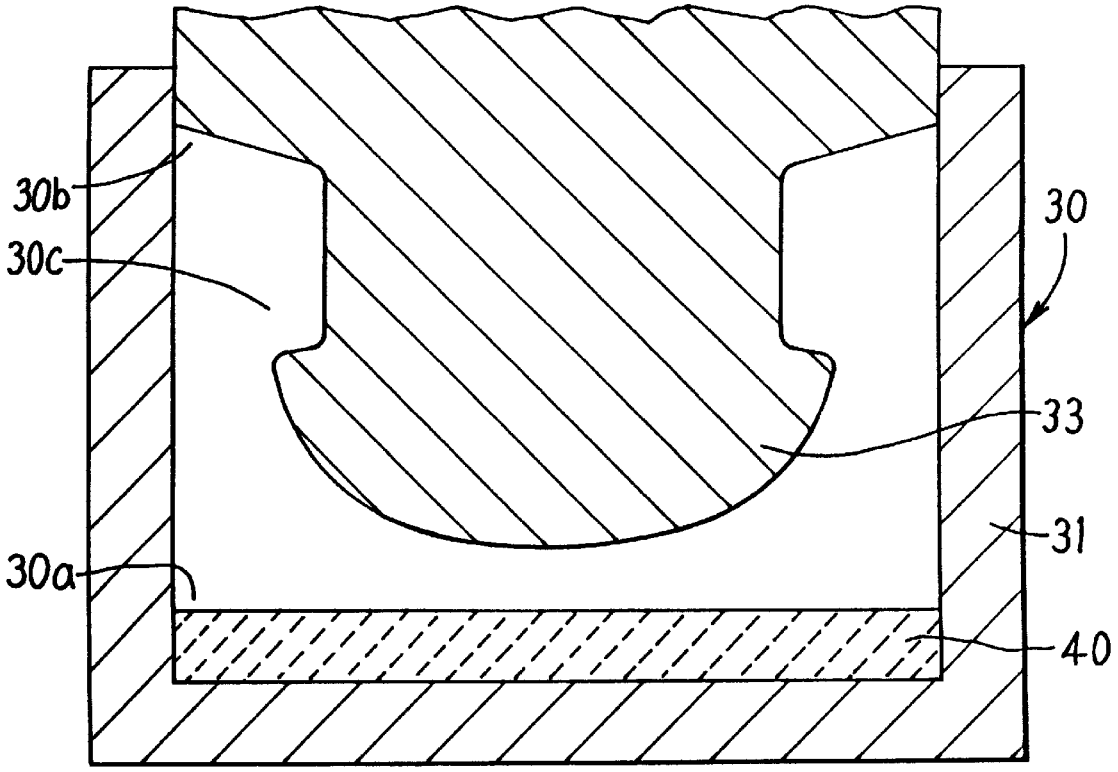
FIG. 2 is a schematic sectional view of a casting mold in which a piston is cast in accordance with an embodiment of the present invention.

Prior to introducing the molten matrix-forming alloy into the mold 30, ceramic reinforcing material 40 is positioned in the crown-forming region 30*a* thereof as illustrated in FIG. 2 so as to be infiltrated with the molten alloy and thereby incorporated into the cast piston at the crown region thereof. The reinforcing material 40 typically is placed on the bottom wall of the female die 31 so as to be located at or close to (e.g. within a few (1–2) microns) of the upper crown wall 20*a* of the cast piston 10.

In accordance with an embodiment of the present invention, the ceramic reinforcing material 40 and the molten matrix-forming alloy are selected so that they react upon contact in the mold crown-forming region 30*a* to locally alter the matrix-forming alloy composition there, while the matrix-forming alloy composition remains essentially unaltered at the other regions 30*b*, 30*c* of the mold 30. For example only, when the molten alloy comprises an aluminum alloy including Si, Mg, and Cu, the alloy composition is locally altered at the mold crown-forming region 30*a* in a manner that a subsequent precipitation hardening heat treatment of the cast piston 10 forms precipitates comprising platelet precipitates in the microstructure of the piston crown region 20 in contrast to spheroidal or rounded precipitates that are formed in the microstructure of the unaltered alloy composition at skirt and boss regions 16, 18 of the cast piston.

An exemplary aluminum alloy includes about 0.5 to about 1.5 weight % Mg, about 0.5 to about 5 weight % Cu, about 7 to about 20 weight % Si, and balance essentially aluminum, although a variety of other aluminum alloys including Si, Mg, Cu and other possible alloying elements can be used as well. When such an aluminum alloy is introduced into the mold of FIG. 2 and squeeze cast therein, dendrites form and propagate through the molten alloy to provide a solidified microstructure including intermetallic compounds which form as primary precipitates between and/or within the dendrites in the solidified alloy microstructure, leaving however some remnant Si, Mg, and Cu in solid solution in the dendrites.

The ceramic reinforcing material 40 is selected to react with the magnesium constituent of the molten aluminum alloy at the mold crown-forming region 30*a* in a manner that reduces the remnant magnesium concentration in the solidified dendrites. In particular, the magnesium concentration is reduced in the dendrites at the mold crown-forming region 30*a* to provide platelet precipitates throughout the alloy matrix microstructure of the piston crown region 20 during a subsequent precipitation hardening heat treatment of the solidified cast piston, although some minor amount of the platelet precipitates may occur during solidification and cooling of the molten aluminum alloy in the mold 30 depending on the cooling rate involved. Illustrative Mg concentrations to this end are set forth below in the examples. The magnesium depleted region of the aluminum alloy resulting from the ceramic/alloy reaction typically is confined within close proximity, e.g. within a few (1–2) microns, of the ceramic reinforcing material 40 (e.g. preform fibers).

As a result, the alloy composition at other regions of the mold 30 remains substantially unaltered and will have relatively higher magnesium concentration, and thus relatively higher Mg in the dendrites effective to precipitate spheroidal or rounded precipitates throughout the alloy matrix microstructure at the skirt, boss and other regions of the cast piston during the subsequent precipitation hardening heat treatment, although some mi n o r amount of precipitation of spheroidal precipitates may occur during solidification of the molten aluminum alloy in the mold 30 depending on the molten alloy cooling rate in the mold.

Figure 3A:
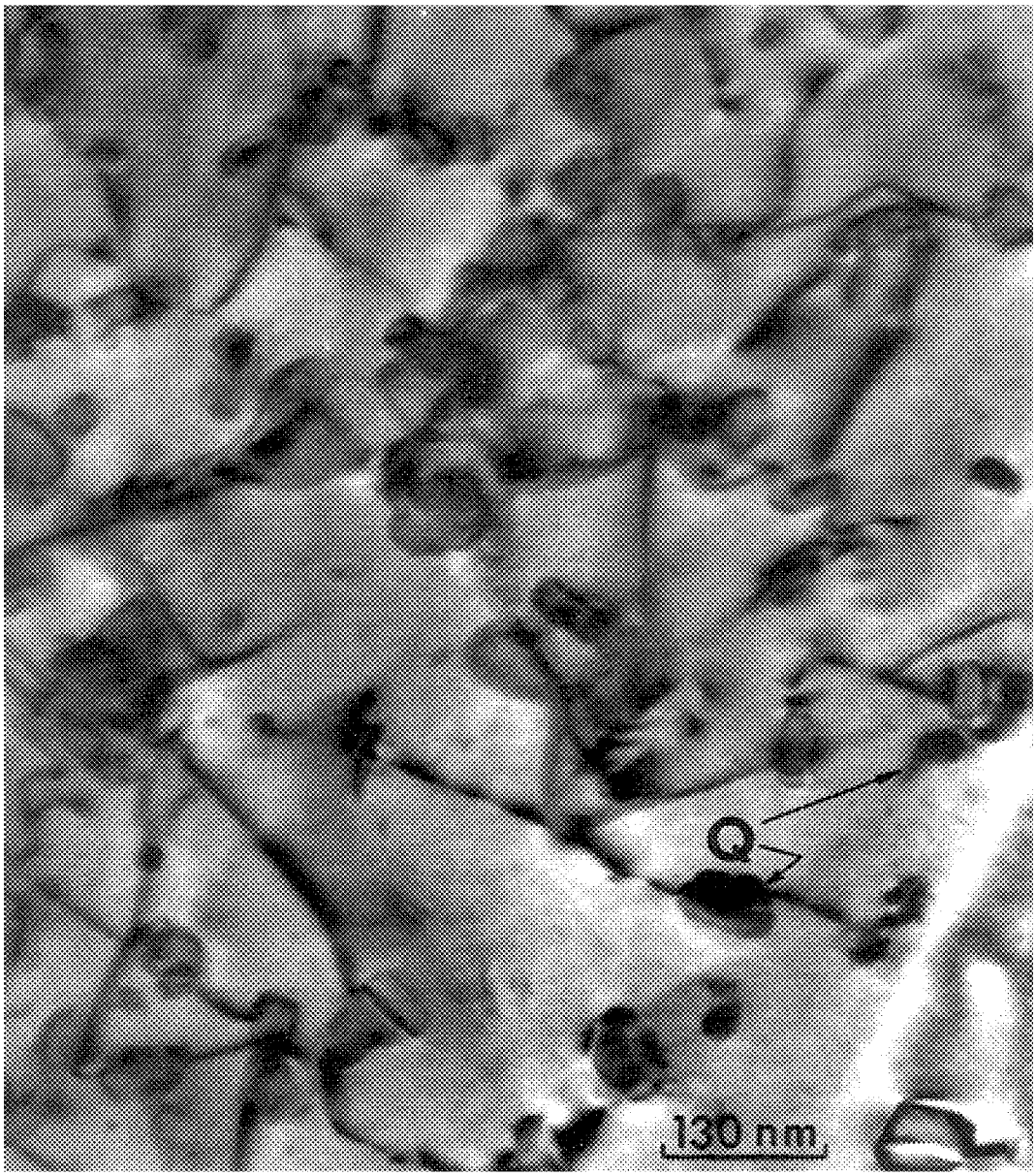
FIG. 3A is a photomicrograph of a particular precipitation hardened 339 aluminum alloy having spheroidal precipitates formed therein.

The strengthening precipitates formed preferentially in the microstructure of the skirt, boss and other regions of the piston comprise silicon spheroidal particles and quaternary Si—Cu—Mg—Al compounds as spheroidal particles, they appear in the precipitation hardened microstructure as having a general spheroidal or rounded morphology with typical particle diameters of approximately 50 nm, see gray spheroidal precipitates Q in FIG. 3A. In FIG. 3A, the linear features comprise dislocations.

Figure 3B:
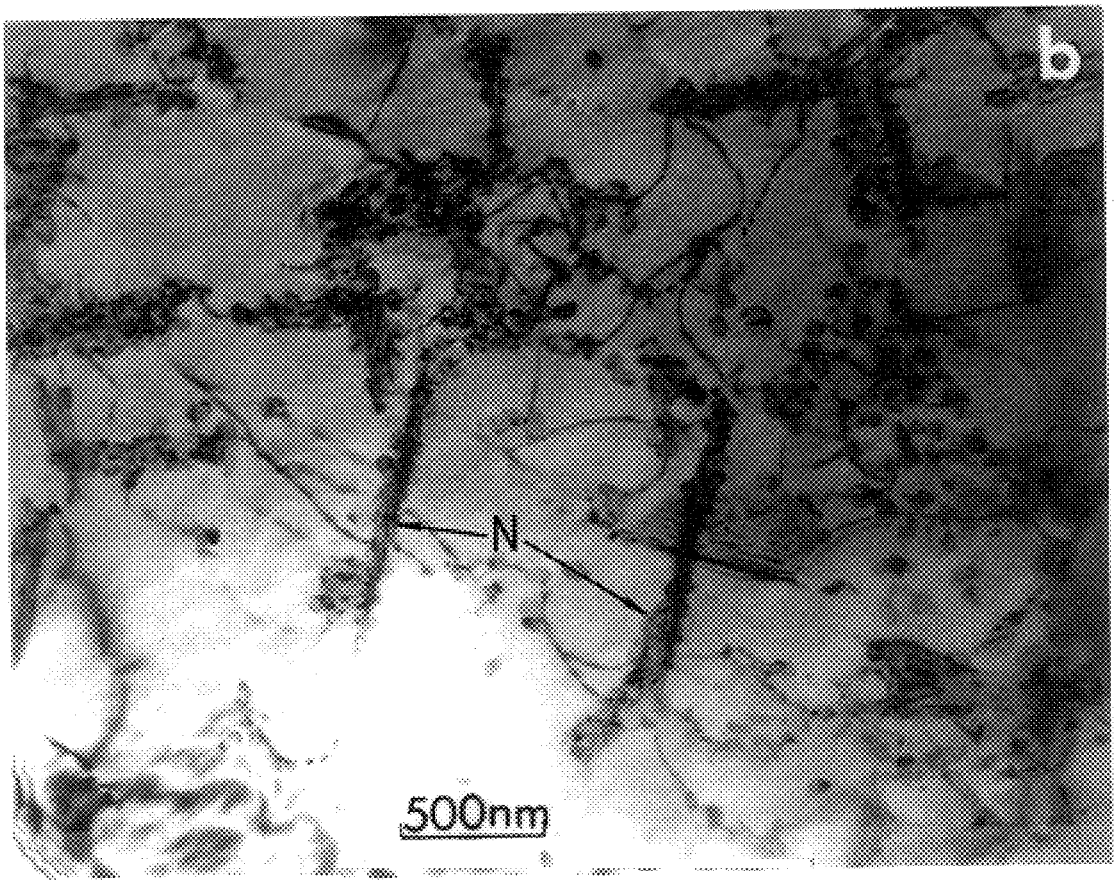
FIG. 3B is a photomicrograph of a similar precipitation hardened 339 aluminum alloy having both spheroidal precipitates and platelet precipitates formed therein by virtue of modification of the alloy composition to have less Mg.

The platelet precipitates formed preferentially in the alloy matrix microstructure of the crown region 20 are believed to also comprise silicon platelets and one or more quaternary Si—Cu—Mg—Al compounds as platelets, although the invention is not intended to be limited to any particular composition of the precipitates. Both precipitates appear in the precipitation hardened microstructure as having a platelet morphology with typical platelet transverse or width dimensions of 500–1000 nanometers (nm) diameter and 30 nm thickness, see platelet precipitates N in FIG. 3B. The microstructure of the crown region 20 may include some spheroidal precipitates.

An exemplary reaction to alter the alloy composition in the manner described above can be provided by using a silica-bearing ceramic reinforcing material 40 and an aluminum alloy of the type described above wherein the reaction: $SiO_2+2Mg=2\ MgO+Si$ occurs between the silica of the ceramic reinforcing material and the magnesium of the alloy. In this reaction, the silica constituent of the reinforcing material reacts with the magnesium alloying constituent of the aluminum alloy to form magnesium oxide and silicon, which becomes incorporated as an interfacial layer. A suitable ceramic reinforcing material found effective to achieve the above reaction in the mold crown-forming region 30*a* includes alumino-silicate comprising 96 weight % alumina and 4 weight % silica bonded together by a silica binder, although other silica-bearing ceramic materials can be used to this same end.

The reaction between the ceramic reinforcing material 40 and the molten matrix-forming alloy composition not only locally alters the alloy composition in the crown-forming region 30*a* of the mold for purposes described above, but also forms a strong interfacial bond between the ceramic reinforcing material, such as ceramic fibers and/or particles, and the solidified matrix alloy so that mechanical reinforcement of the crown microstructure is enhanced.

The cast piston then is subjected to a precipitation hardening heat treatment wherein the platelet precipitates described above form a very fine dispersion of precipitates throughout the solidified dendritic microstructure of the piston crown region 20 and the spheroidal or rounded precipitates form a very fine dispersion of precipitates throughout the solidified dendritic microstructure of the piston skirt 16, boss 18 and other regions. The precipitation hardening heat treatment typically involves heating the solidified cast piston at 210 degrees C. for 8 hours to produce a so-called known T5 heat treat condition. However, the invention is not limited to any particular precipitation hardening heat treatment parameters. The T5 precipitation hardening heat treatment can be used in practice of the present invention to develop superior fatigue strength in the piston crown region 20 exposed to higher engine service temperatures, by virtue of the platelet precipitates, and yet also provide superior fatigue strength in other regions of the piston exposed to lower engine service temperatures by virtue of the presence of the spheroidal strengthening precipitates in the microstructure at those regions.

Regardless of the precipitation hardening heat treatment used, the spherical strengthening precipitates initially impart more strength to the alloy than the platelet precipitates as is apparent from Table I. However, the spheroidal precipitates overage at elevated temperatures (e.g. engine service temperatures at the crown region 20) more rapidly than the platelet precipitates. As a result, after prolonged exposure at elevated service temperatures (e.g. 300 degrees C. or greater), the platelet precipitates impart more strength (e.g. tensile strength 219 MPa in Table I) than the spheroidal precipitates (e.g. tensile strength of 205 MPa in Table I). Thus, the platelet precipitates are preferred in the crown region 20 of the piston, while the spheroidal precipitates are preferred at other regions of the piston.

TABLE I

EFFECT OF MAGNESIUM CONCENTRATION ON PRECIPITATES AND TENSILE STRENGTH (MPa) OF 339AL PISTON ALLOY

| | | |
|---|---|---|
| Mg Concentration (wt. %) | 1.15 | 0.73 |
| Precipitate Morphology | Spheroidal | Platelet |
| Initial Strength | 310 | 254 |
| Strength After 300 hrs./300° C. | 205 | 219 |

The tensile strength values set forth in Table I were measured using precipitation hardened tensile specimens comprising 339 aluminum base alloy, sans ceramic reinforcing material, with different magnesium concentrations in order to demonstrate how different precipitates can be formed at different Mg concentrations. For example, magnesium concentrations of 1.15 weight and 0.73 weight % of the alloy were used for a Cu concentration of 1.1 weight % of the 339 aluminum alloy. The different Mg concentration resulted in formation of different strengthening precipitates in the matrix microstructure upon T5 precipitation hardening heat treatment. In particular, the higher Mg concentration yielded only the aforementioned spheroidal precipitates in the specimens, FIG. 3A, while the lower Mg concentration yielded a combination of the aforementioned platelet precipitates and spheroidal precipitates in the tensile specimens, FIG. 3B.

In practicing the present invention, the reaction between the ceramic reinforcing material 40 and the magnesium (or other reactive alloying element) of the matrix-forming alloy in the mold crown-forming region 30*a* is controlled by appropriate selection of chemical composition and volume fraction of the ceramic reinforcing material relative to the alloy in the mold crown-forming region during casting, the temperatures of the ceramic reinforcing material and the alloy in the mold crown-forming region, the cooling rate of the molten alloy, and the alloy composition in which the Mg concentration is controlled to equal or exceed that required to form spheroidal precipitates in the microstructure at piston regions other than the crown region upon precipitation hardening. Various combinations of these parameters can be employed to provide the necessary amount of reaction between the ceramic reinforcing material and the molten alloy in the mold crown-forming region to selectively tailor mechanical properties of the piston microstructure to different service conditions experienced by different regions of the piston pursuant to the invention.

The following is offered to illustrate squeeze casting parameters that can be employed to cast a gasoline engine piston from 339 aluminum alloy nominally comprising 12 weight % Si, 1 weight % Cu, 1 weight % Mg, 1 weight % Ni, and 0.5 weight % Fe, and balance aluminum. A porous disc-shaped preform comprising alumino-silicate (alumina fibers/silica fibers with silica binder described above) is positioned in the female mold 31 as shown in FIG. 2 and is selected to provide a volume fraction of 15% relative to the volume of the matrix alloy. The preform is infiltrated with the molten 339 aluminum alloy using a preform temperature of 600 degrees C., metal temperature of 730 degrees C., and final applied pressure of 70 MPa exerted by punch 33, and the alloy is solidified in the mold. Following removal from the mold, the solidified cast piston can be subjected to a precipitation hardening heat treatment as described above.

While the invention has been disclosed primarily in terms of specific embodiments thereof, it is not intended to be limited thereto but rather only to the extent set forth hereafter in the claims which follow.

We claim:

1. A cast piston for an internal combustion engine, comprising a crown region subjected to relatively higher service temperature than other regions of said piston, said crown region having a microstructure including a metallic matrix with reinforcing material and strengthening precipitates therein providing strength properties suited to said higher service temperature by virtue of said precipitates having better resistance to overaging during engine service than different strengthening precipitates formed in a microstructure of said other regions of said piston, said different precipitates providing strength properties suited to relatively lower service temperatures at said other regions.

2. The piston of claim 1 wherein said matrix comprises an aluminum alloy.

3. The piston of claim 2 wherein said aluminum alloy includes Mg as an alloying element.

4. The piston of claim 3 wherein said rein forcing material comprises a ceramic material reactive with said Mg alloying element.

5. The piston of claim 1 wherein said reinforcing material comprises a preform.

6. The piston of claim 1 wherein said crown region includes said strengthening precipitates having a morphology different from that of said different precipitates at said other regions.

7. The piston of claim 6 wherein said crown region includes platelet precipitates and said other regions include spheroidal precipitates.

8. The piston of claim 7 wherein said spheroidal precipitates comprise silicon.

9. The piston of claim 7 wherein said platelet precipitates comprise silicon.

10. A cast aluminum alloy piston for internal combustion engine, comprising a crown region subjected to relatively higher service temperature than other regions of said piston, said crown region having a microstructure including ceramic reinforcing material and platelet precipitates and said other regions having a microstructure comprising spheroidal precipitates.

11. The piston of claim 10 wherein said microstructure at said crown region differs in alloy composition from that at said other regions.

12. The piston of claim 11 wherein a Mg concentration of said alloy composition is less at said crown region than at said other regions.

13. A method of making a piston for an internal combustion engine, comprising introducing molten matrix-forming alloy into a casting mold including reacting a ceramic reinforcing material and said molten matrix-forming alloy at a crown-forming region of said casting mold to locally alter alloy composition in said crown-forming region, solidifying said alloy to form a cast piston having a crown region and other regions, and precipitation hardening said cast piston whereby said locally altered alloy composition yields strengthening precipitates at said crown region providing strength properties suited to said higher service temperature by virtue of said precipitates having better resistance to averaging during engine service compared to different precipitates formed by the unaltered alloy composition at said other regions of the cast piston, said different precipitates providing strength properties suited to relatively lower service temperatures at said other regions.

14. The method of claim 13 wherein said reinforcing material comprises a ceramic preform.

15. The method of claim 13 wherein said casting mold comprises a metallic mold.

16. The method of claim 13 wherein said altered alloy composition yields precipitates at said crown region having a different morphology from said precipitates at said other regions.

17. A method of making a piston for an internal combustion engine, comprising introducing a molten matrix-forming aluminum alloy including magnesium into a casting mold including reacting a ceramic reinforcing material and said magnesium of said molten matrix-forming aluminum alloy at a crown-forming region of said casting mold in a manner to locally alter alloy composition by reducing magnesium concentration thereof residing in said crown-forming region, solidifying said alloy to form a cast piston having a crown region and other regions, and precipitation hardening said cast piston whereby said altered alloy composition having reduced magnesium concentration yields precipitates at said crown region providing strength properties suited to higher service temperature by virtue of said precipitates having improved resistance to averaging during engine service as compared to different precipitates formed in the unaltered alloy composition at said other regions of the cast piston, said different precipitates providing strength properties suited to relatively lower service temperatures at said other regions.

18. The method of claim 17 wherein said crown region of said piston includes platelet precipitates and said other regions include spheroidal precipitates.

* * * * *

UNITED STATES PATENT AND TRADEMARK OFFICE

CERTIFICATE OF CORRECTION

PATENT NO. : 6,202,618 B1
DATED : March 20, 2001
INVENTOR(S) : William J. Baxter, et al.

It is certified that error appears in the above-identified patent and that said Letters Patent is hereby corrected as shown below:

Claim 13,
Line 28; delete "said".
Line 30; change "averaging" to overaging".

Claim 17,
Line 24, change "averaging" to overaging".

Signed and Sealed this

Thirtieth Day of October, 2001

*Attest:*

Nicholas P. Godici

NICHOLAS P. GODICI
*Acting Director of the United States Patent and Trademark Office*

*Attesting Officer*